United States Patent [19]

Flensburg et al.

[11] Patent Number: 4,494,360

[45] Date of Patent: Jan. 22, 1985

[54] APPARATUS FOR BUNDLING SHEETS FOR FASCICLES

[76] Inventors: Carl G. A. Flensburg, Per Albin Hanssons väg 52 B, S-214 63 Malmö; Rolf H. V. Isaksson, Diakongatan 59, S-216 23 Malmö, both of Sweden

[21] Appl. No.: 341,992

[22] PCT Filed: May 13, 1981

[86] PCT No.: PCT/SE81/00144

§ 371 Date: Jan. 15, 1982

§ 102(e) Date: Jan. 15, 1982

[87] PCT Pub. No.: WO81/03315

PCT Pub. Date: Nov. 26, 1981

[30] Foreign Application Priority Data

May 13, 1980 [SE] Sweden ..... 8003573

[51] Int. Cl.[3] ..... B65 63/02; B65 13/20; B65 13/04; B65 13/06

[52] U.S. Cl. ..... 53/528; 53/589; 100/3; 100/17

[58] Field of Search ..... 53/528, 529, 589, 523; 100/3, 17, 33 PB

[56] References Cited

U.S. PATENT DOCUMENTS

| | | | |
|---|---|---|---|
| 2,087,774 | 7/1937 | Lovette . | |
| 3,521,550 | 7/1970 | Van Doorn et al. | 53/589 X |
| 4,224,780 | 9/1980 | Rewitzer | 53/528 X |
| 4,244,773 | 1/1981 | Siebeck et al. | 53/589 X |
| 4,271,655 | 6/1981 | Nagayoshi | 53/589 X |

FOREIGN PATENT DOCUMENTS 1253050 11/1971 United Kingdom .

*Primary Examiner*—Horace M. Culver

*Attorney, Agent, or Firm*—Cushman, Darby & Cushman

[57] ABSTRACT

An apparatus for bundling sheets or fascicles (11) which are supplied one by one and arranged in a regular loose bundle with the flat sides towards one another. The bundle is pushed in the transverse direction thereof from a bundling position in between press plates (26, 27) which are mutually spaced and are relatively movable towards and away from one another in a strapping position. A band (38) or the like is fed in the longitudinal direction thereof and means are provided to guide the band in a loop round the bundle compressed between the press plates. The loop is sealed by sealing means after which the bundle is pushed in its transverse direction from the strapping position.

4 Claims, 4 Drawing Figures

APPARATUS FOR BUNDLING SHEETS FOR FASCICLES

The present invention relates to an apparatus for bundling sheets or fascicles which are supplied one by one and are arranged in a regular loose bundle with the flat sides towards one another.

The invention has come about particularly for the handling of so-called signatures in the production of weekly magazines and similar printed products. The usual thing today is for the signatures to be delivered from the printing press in an upright stack which is then lifted manually into the so-called station stapler where the signatures are assembled and stapled. The object of the invention is to eliminate this manual handling, which is both hard and tiring, and to render possible an effective mechanical transfer of the signatures from the printing press to the station stapler.

For this purpose, an apparatus has been created for bundling sheets or fascicles, which are supplied one by one and are arranged in a regular loose bundle with the flat sides towards one another, comprising a bundling position for building up the loose regular bundle of sheets or fascicles supplied, a strapping position disposed at the side of the bundling position, in parallel therewith, in the longitudinal direction of the bundle, means for displacing a bundle in the transverse direction thereof from the bundling position to the strapping position, means for feeding a band or the like in the longitudinal direction thereof to the strapping position, means for guiding the band in a loop round the bundle in the strapping position and means for sealing a loop of band laid round the bundle in the strapping position, said apparatus having obtained the characteristics which can be seen from claim 1.

Figure 1:
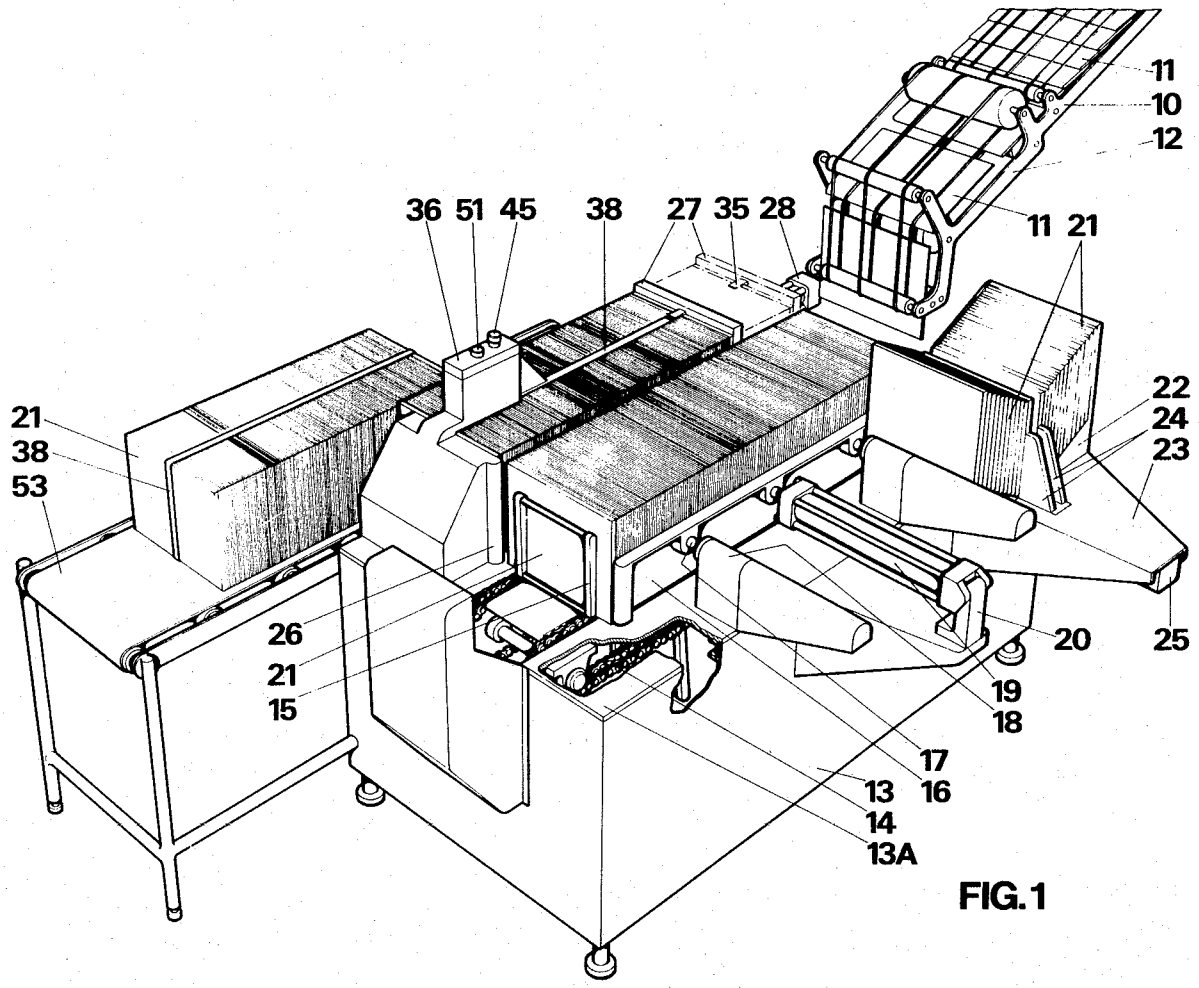
Figure 2:
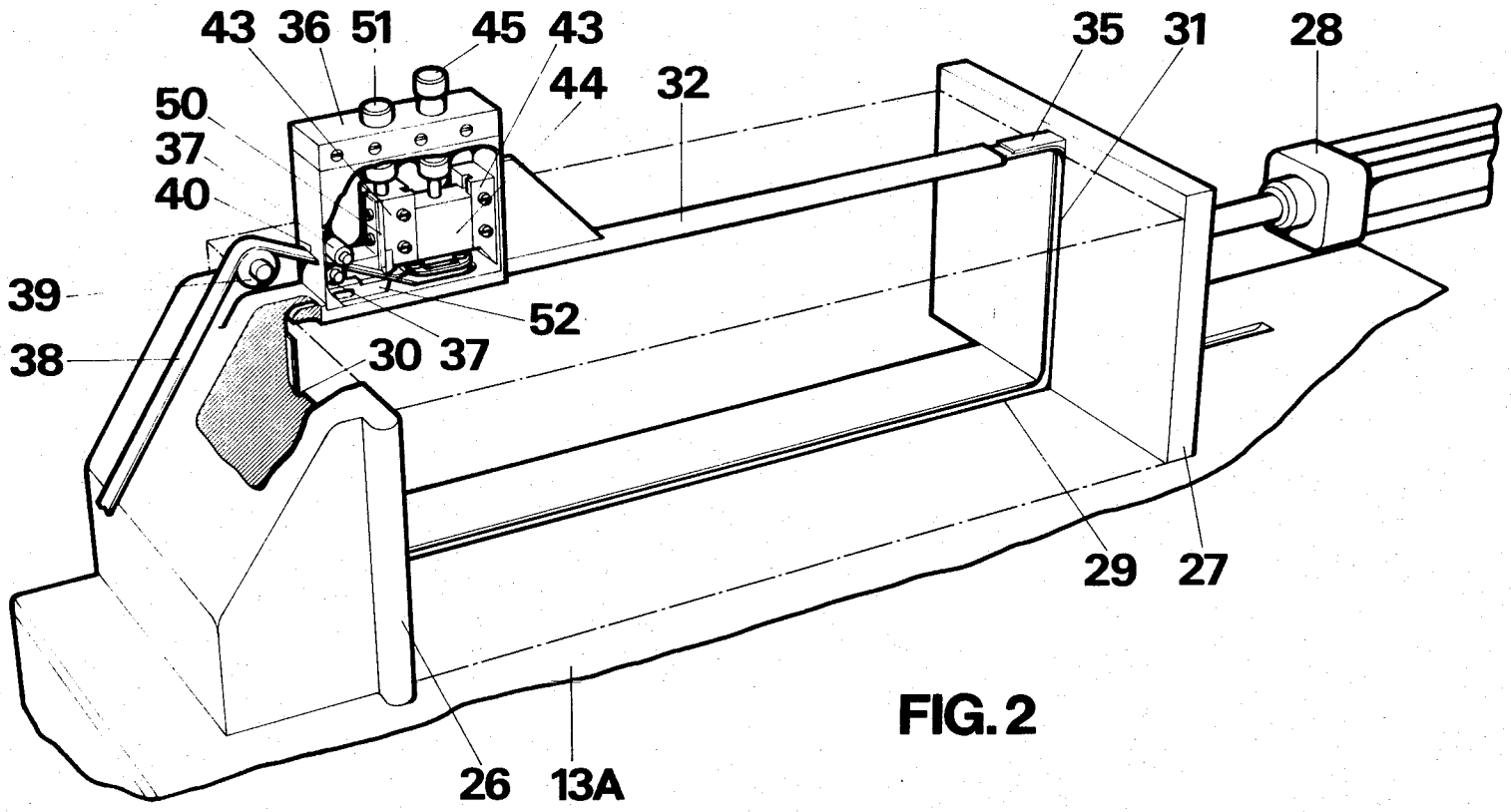
Figure 4:
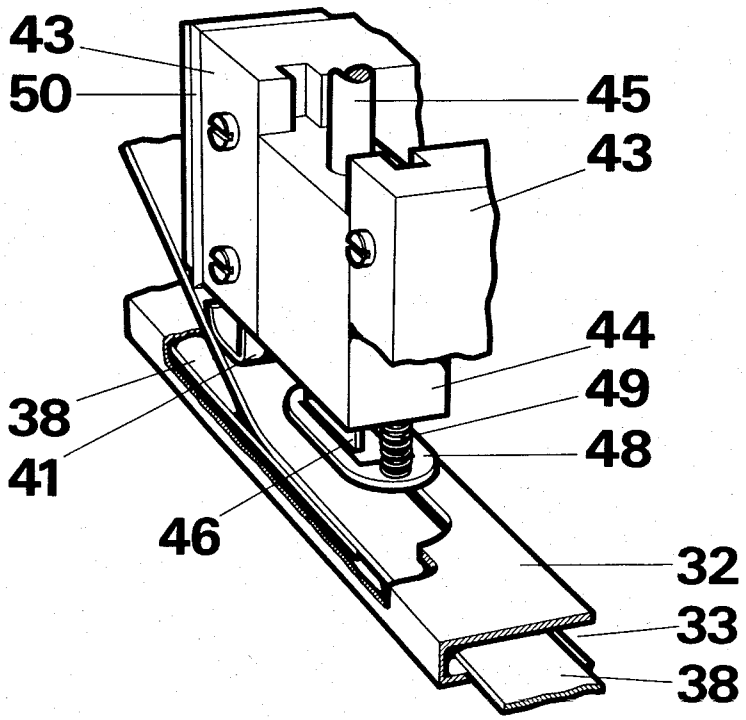
Figure 3:
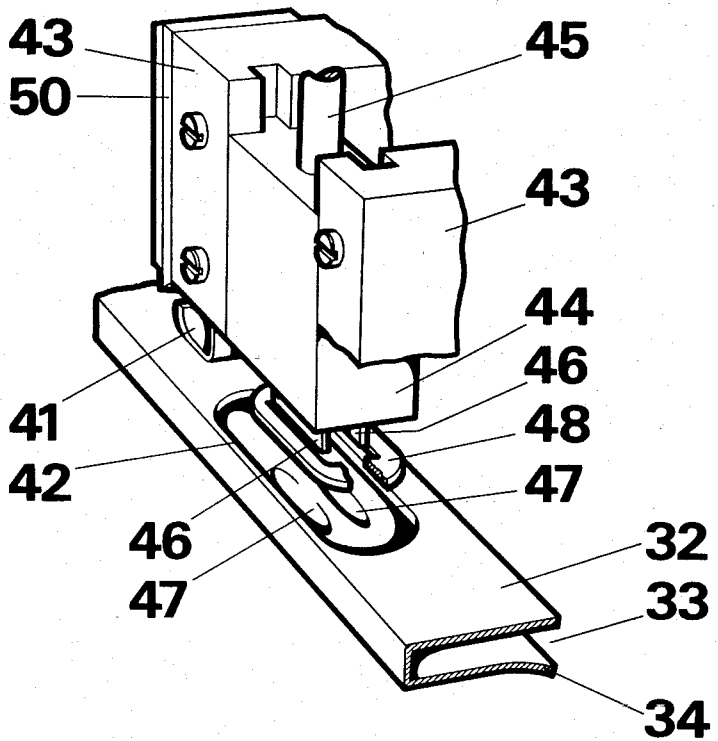

In order to illustrate the invention, this will be described in more detail below with reference to the accompanying drawings which show one embodiment of the apparatus according to the invention and in which FIG. 1 is a general view in perspective of the apparatus, FIG. 2 is an enlarged perspective view, partially broken away, of the strapping position in the apparatus, FIG. 3 is a fragmentary perspective view of means for sealing the band which is laid round the bundle in the strapping position, shown in the empty state, and FIG. 4 is a view corresponding to FIG. 3 but with a band in position for sealing.

In FIG. 1, to which reference is first made, a conventional conveyor 10 is shown for delivering printed products from a printing press, which are designated by 11 and in the present case are assumed to be signatures for a weekly magazine or the like. The signatures overlap one another partially on the conveyor but at the end portion 12 thereof, separation of the signatures is brought about and they are delivered from the end portion in a substantially vertical path.

The apparatus according to the invention is associated with the end portion 12 of the conveyor 10 to receive the signatures 11 one by one and comprises a stand 13 with a table top 13A on which a bundling position is disposed following immediately on the end portion 12, and a strapping position is disposed at the side of the bundling position.

The bundling position comprises an endless conveyor 14 with a plurality of mutually separated supports 15 disposed thereon. This conveyor has one run accommodated in the table top 13A, and the signatures 11 are delivered in an upright position to this run of the conveyor 14 which is driven in pace with the conveyor 10 to displace the supports 15 as the bundle grows. The bundle is straightened by means of a rail 16 which extends along the conveyor 14 at one side thereof and is mounted for movement in the transverse direction of the bundle by means of bars 17 which are displaceably received in roller guides 18 on the stand 13. The rail 16 is displaceable by means of a double-acting pneumatic cylinder 19 which is mounted on the stand by means of a bracket 20.

Each bundle which is formed in the bundling position should begin and end with a stiff panel 21, and a plurality of such panels are disposed in a magazine 22 on a bracket 23 on the stand 13. The magazine 22 is arranged such that the panels 21 move by their own weight down towards the middle of the magazine from opposite ends thereof, and the panels which are in the middle of the magazine are spaced, by means of a spacing member not shown, a distance which corresponds to the thickness of a support 15. Two carriers 24 are displaceable by means of a pneumatic cylinder 25 to insert two panels 21, one at each side of the support 15 when this is in register with the spacing member in the magazine 22, as a result of which the one panel will be located at the end of a finished bundle of signatures 11 and the other sheet will be located at the beginning of a new bundle of signatures 11. The conveyor 10 is coordinated with the apparatus according to the invention in such a way that the supply of signatures is temporarily stopped while the panels 21 are moved into position one at each side of a support 15.

Thus, it will be seen that a regular bundle of signatures 11 is built up on the conveyor 14 between stiff panels 21, as the signatures are supplied from the conveyor 10; the bundle is growing successively from the supply point of the signatures while one of the supports 15 is displaced, as a result of the movement of the conveyor 14, successively along the rail 16. As will be realized, the spacing between the supports 15 on the conveyor 14 should correspond to the desired length of bundle.

After a loose bundle of signatures lying with the flat sides towards one another, has been completed in the bundling position, said bundle having a predetermined length, the bundle must be transferred to the strapping position which is brought about by the bundle being displaced in the transverse direction thereof by means of the rail 16 and the cylinder 19.

The strapping position, which is shown in more detail in FIG. 2, to which reference is now made, comprises a stationary press plate 26 and a movable press plate 27 which is coupled to a double-acting pneumatic cylinder 28 and is adapted to slide on the table top 13A. A groove 29 is provided in the table top, and a corresponding groove 30 is provided in the press plate 26 and a corresponding groove 31 in the press plate 27, the grooves 30 och 31 extending vertically in the middle of the plates 26 and 27 and joining the groove 29 at their lower ends. At the top, the groove 30 joins a channelled guide 32 which is shown in more detail in FIGS. 3 and 4. As can be seen from these, the guide 32 has an opening 33 at one side where the bottom of the guide is bent down somewhat at 34. The guide 32 is fixedly connected to the press plate 26 and is supported in a cantilever fashion by this plate, the guide extending in parallel to the groove 29 directly above this. Disposed on the movable press plate 27, following on the upper end of the groove 31, is a guide 35 which is curved over 90° and which does not need to be channelled but may consist of a simple tongue.

Supported on the press plate 26 is a housing 36 in which there are disposed two rotatably mounted pressure rollers 37, one of which is coupled to a drive motor. A band 38 of thermoplastics material, for example polyethylene, which comes from a supply roll for such band, not shown, which can be mounted in a suitable manner on the stand 13, is extended over a guide roller 39, rotatably mounted on the press plate 26 through a slot 40 into the housing 36 where the band passes between the pressure rollers 37. The band is extended under a guide shoe 41 into the guide 32 through an opening 42 in the upper wall of the guide, and as a result of the fact that one of the rollers 37 is rotated, the band 38 can be pushed through the guide 32 to be then bent down by means of the curved guide 35 into the groove 31, further through the groove 29 and then up through the groove 30 and again in the guide 32 where the free end of the band then passes in under the part of the band already there. In order that the band 38 may pass without hindrance from the groove 31 to the groove 29, the groove 31 has a gentle bend at its lower end and also the transitions between the groove 30 and the groove 29 and the guide 32, respectively, are gently rounded.

With the movable press plate 27 pulled back by means of the cylinder 28 to the position shown by chain lines in FIG. 1, the bundle is pushed from the bundling position in between the press plates 26 and 27 in the strapping position, after which the loose bundle is pressed together by the press plate 27 being pushed, by means of the cylinder 28, towards the stationary press plate 26 to the position shown in full lines in FIG. 1. This position is also shown in FIG. 2. A band is now fed through the closed path which is formed by the guides 32 and 35 and by the grooves 29, 30, and 31, in the manner described above, as a result of one of the pressure rollers 37 being rotated. The movement of the band is stopped when the free end of the band is partly under the incoming part of the band in the band guide 32, and this may preferably be effected by the driven pressure roller 37 being rotated for a predetermined period which is determined empirically in view of the feed rate of the band and the length of the loop formed by the band.

The band 38, which now forms a loop round the compressed bundle of signatures 11, must now be sealed and severed from the band supply, and means for this are disposed in the housing 36.

With reference to FIGS. 2 to 4, the means provided for sealing the band comprise a slide 44, which is guided for movement vertically by means of guides 43 in the housing 36 and which is coupled to a pneumatic cylinder 45 to bring about the movement thereof up and down. Disposed on the slide 44 are two press jaws 46 which are displaceable downwards into two oval depressions 47 in the bottom of the guide 32 through the opening 42 for the band. The jaws 46 may be provided with heaters for heating them or may constitute electrodes in an HF circuit, in which case the guide 32 forms the other electrode in this circuit. Also disposed on the slide 44 is an annular holding down member 48 which is guided for movement in relation to the slide 44 by springs 49 disposed between the slide and the holding down member. The holding down member is situated somewhat below the jaws 46.

The overlapping portions of the band 38, FIG. 4, are sealed by the slide 44 being pushed down towards the band by means of the cylinder 45. The holding down member 48 is first engaged with the band and then the jaws 46, on the continued downward movement of the slide 44, are engaged with the band, compressing the springs 49. The thermoplastics material of the band becomes soft through the heating from the heated jaws 46 and is deformed down into the oval depressions 47 while at the same time the overlapping layers of band are fused together. As a result, a strong and secure sealing of the loop of band surrounding the bundle is obtained.

For cutting off the loop of band from the band supply, a knife 50 is guided for displacement on one guide 43, which knife is coupled to a pneumatic cylinder 51 to be imparted a reciprocating movement in the vertical direction, and this knife is adapted to cooperate with a fixed counter cutter 52 in the housing 36 to cut off the loop of band from the band supply.

After the bundle has been strapped, the press plate 27 is withdrawn by means of the cylinder 28 to the position shown in chain lines in FIG. 1. During the period when a bundle was being strapped in the strapping position, a new bundle has been built up in the bundling position, and when this bundle is pushed into the strapping position by means of the rail 16 and the cylinder 19, the strapped bundle is simultaneously removed from the strapping position. At the side of this there is disposed a conveyor 53 for receiving the strapped bundle and conveying this to a store or directly to a station stapler.

The operations described above should of course be coordinated with one another so that they take place in the correct sequence and at the correct time, and this coordination can be effected in a manner known per se by means of a timer which controls contactors and magnetically operated valves for the electrical and pneumatic circuits, respectively.

The displacement of the banded bundle from the strapping position to the conveyor 53 is rendered possible by the fact that the guide 32 has a lateral opening 33 through which the band 38 can slide out of the guide. Furthermore, the groove 29 should not have such a great depth that the band cannot slide out of the groove on displacement of the strapped bundle in the transverse direction of the groove.

Instead of the bundle being built up horizontally, as in the embodiment described, the bundle can be built up substantially vertically and preferably in a somewhat inclined position, since the actual bundling becomes easier as a consequence thereof and above all the stiff panels 21 can be applied more easily at the beginning and the end of the bundle. This does not alter anything in principle, however, since the bundling and strapping can still be carried out in the manner described above.

The strapped bundles, so-called "loaves", are easy to handle mechanically without risk of the signatures being damaged. Above all these loaves render it possible for the manual step involved in lifting the signatures into the station stapler to be completely eliminated.

Of course, the apparatus described here can be modified with regard to its constructional details within the scope of the accompanying claims.

It is most appropriate to effect the strapping by means of a band but principally it is also possible to use a wire.

In the embodiment shown, the table top is disposed horizontally but it can also be inclined to the horizontal and form a support with an inclination of about 30° for example in the longitudinal direction of the bundle.

We claim:

1. An apparatus for bundling sheets of fascicles supplied one by one and arranged in a regular loose bundle with flat sides, said apparatus including a bundling position for building up the loose regular bundle of sheets or fascicles on a support surface, a strapping position on said support surface disposed along side said bundling position, in parallel relation therewith, and parallel to the longitudinal dimension of the bundle, means for displacing a bundle from said bundling position to said strapping position in a direction transverse to said bundling position, means for feeding a band or the like in a direction generally parallel to the longitudinal dimension of a bundle in the strapping position, means for guiding the band in a loop around a bundle in the strapping position and means for sealing a loop of band laid around a bundle in the strapping position, wherein the improvement comprises:

said strapping position having spaced apart press plates, with one of said plates being movable toward and away from the other plate to compress a bundle located between said plates, said means for guiding the band in a loop around a bundle compressed between said press plates comprising a groove formed in each said press plate and a groove in said support surface for the bundle with said groove in said support surface extending parallel to the longitudinal dimension of the bundle and with said groove in said support surface extending between said grooves in said press plates, said grooves in said press plates intersecting said groove and said support surface at right angles, said means for guiding the band further including a guide member located in a plane that passes through said groove in said support surface and said grooves in said press plates but being spaced from said groove in said support surface and extending parallel thereto, said guide member having one end which extends from one of said press plates.

2. An apparatus as claimed in claim 1, characterized in that the guide member comprises a tube with a lateral opening extending along the tube.

3. The apparatus as claimed in claim 2 wherein said guide tube has an opening on one side thereof and said means for feeding the band consists of pressure rollers, one of which is driven, and located to feed the band into said opening in said guide member.

4. The apparatus as claimed in claim 3 wherein said means for sealing the loop of a band laid around a bundle comprises a first and second jaw, with said first jaw being located in the bottom of said guide in the opening thereof, said second jaw being displaceable toward said first jaw perpendicular to the band so that the band will be engaged between said jaws in said opening, said apparatus further including means for heating said jaws.

* * * * *